United States Patent [19]

Gebler

[11] 4,328,734

[45] May 11, 1982

[54] WIND INSTRUMENT KEY

[76] Inventor: James M. Gebler, 204 S. 3rd Ave., Superior Rte., Louisville, Colo. 80027

[21] Appl. No.: 79,849

[22] Filed: Sep. 28, 1979

[51] Int. Cl.[3] ..... G10D 7/00; G10D 7/08

[52] U.S. Cl. ..... 84/380 R; 84/385 R

[58] Field of Search ..... 84/385 R, 380 R, 381, 84/382, 384

[56] References Cited

U.S. PATENT DOCUMENTS

| | | | |
|---|---|---|---|
| 2,555,980 | 6/1951 | Loney | 84/385 |
| 2,686,450 | 8/1954 | Sander | 84/380 |
| 3,421,398 | 1/1969 | Whiteside et al. | 84/380 |
| 3,501,991 | 3/1970 | Carruthers et al. | 84/380 |
| 3,504,590 | 4/1970 | Bedford | 84/380 |
| 3,857,317 | 12/1974 | Carree | 84/380 |
| 3,865,005 | 2/1975 | Carree | 84/380 |

*Primary Examiner*—George H. Miller, Jr.
*Assistant Examiner*—Thomas H. Tarcza
*Attorney, Agent, or Firm*—O'Rourke & Harris

[57] ABSTRACT

A wind instrument key in which the arm and foot portions are stabilized. The post supporting the hinge rod is also stabilized and the hinge rod is prevented from lateral movement in the post hole. A novel pad construction prevents air leaks due to shrinking of the pad cover. A means for resiliently contacting a tone hole cover prevents air leaks in combination type keys. A means for modulating energy radiated from the tone hole is included in the key structure. A spring containing means allows adjustable and removable mounting of springs on the key. A cluster of finger contact points includes a rigid plate containing the contact points with each contact point operatively associated with one or more tone hole covers.

8 Claims, 22 Drawing Figures

WIND INSTRUMENT KEY

This invention relates to the field of musical instruments. More particularly, this invention relates to the field of wind instruments. In still greater particularity, this inention relates to wind instrument keys. By way of further characterization but not by way of limitation thereto, this invention relates to a novel key system which facilitates repair and adjustment of the keys while allowing for ease in playing the instrument.

BACKGROUND OF THE INVENTION

The design and construction of wind instrument keys has remained relatively static over a number of years. Manufacturers have been reluctant to alter an accepted design for fear of a lack of acceptance by the musicians in that radically new key systems require some relearning by the musician. Prior art keys, while suited for their intended purpose, are not designed or constructed with durability, ease of repair or ease of playing in mind. While the keys may be acceptable when new, continued use results in bending and fatigue in much of the key structure. Continuous adjustment is thus required resulting in added expense to the musician and rendering the instrument unusable during the repair process.

Prior art keys have one relatively narrow arm portion connecting the tone hole cover with the hinge. When pressure is applied at the finger contact point of the cover a twisting of the arm can occur resulting in air leaks due to improper sealing between the tone hole cover and the tone hole. Pressure at the contact point may also cause the arm to bend causing misalignment of the tone hole cover with the tone hole. This problem may be especially acute in a long key. In addition, handling or storage of the instrument may put pressure on the arm also causing misalignment of the tone hole cover with the tone hole.

Another limitation of prior art keys is their propensity to spread between the arm and foot portions. The arm and foot portions are connected adjacent the hinge and, when the key is released, the shock of the stop on the foot contacting the side of the tone hole may cause spreading between the arm and foot portions of the key. In combination type keys, where one key activates one or more other keys, spreading is a critical problem because one key may contact its tone hole sooner or later than the other key or keys depending upon the amount of spreadng between the arm and foot portions. The result is that some of the keys do not close off the tone hole completely thereby allowing air leaks between the tone hole and the tone hole cover.

A problem similar to that discussed above relates to combination keys in which a foundation extends from one tone hole cover to another. The sudden force of closure may twist the arm and bend the foundation. When this occurs, the tone hole covers will not completely close and air leaks may result.

Besides the problem of arm twisting and bending of the arm portion of keys, the foot portions are also subject to the same problem. That is, the foot portions can move from side to side resulting in problems when other keys are activated by the foot portion. Bending of the foot portions also may result in the foot not contacting the stop as required. This may mean the critical distance between the tone hole cover and its tone hole when open may vary with time requiring considerable flexibility and adaptability by the instrument player in order to control pitch.

The bending of posts which support the hinges may also cause misalignment of the tone hole covers with the tone holes resulting in air leaks. Bent posts may bend or stress hinges thereby causing keys on the hinge to bind in addition to misalignment. Presently used posts are a single rod or shaft attached to the instrument body on one end and supporting the hinge on the opposite end.

Prior art keys have pads which are subject to air leaks caused by uneven pad tension due to shrinking or movement of the pad from moisture or other factors. The pad includes a skin which may shrink if exposed to moisture such as saliva which is carried through the tone hole. Prior art pads employ a skin material on a cushion which fits on the underside of the tone hole cover. The skin material extends around the sides of the cushion layer and is fastened to the top of the cushion. Excess tension on the skin due to moisture induced shrinking or other factors, causes it to compress the cushion layer near the edge of the tone hole cover thereby rendering the pad uneven. Air may then leak between the pad and the tone hole.

Another limitation of prior art wind keys relates to the difficulty in replacing springs when they have been worn or are otherwise in need of repair. It is necessary to remove the entire key to replace conventional springs. Repairs are thus more complicated and expensive then would be the case if the spring could be easily removed. Similarly, adjustments to the spring are difficult and require key removal.

There is a large amount of key vibration due to the playing of the instrument. Thus, many of the set screws used as stops or for other purposes in prior art keys tend to vibrate loose. Continual adjustment of these screws is thus required to keep the keys in proper playing condition.

Problems with unwanted noise due to the metal on metal contact between moving key parts plague all wind instrument musicians. This noise is distracting and may disrupt the concentration of the musician as well as contribute to undesirable background noise. One of the largest contributors to this unwanted noise is the movement of the hinge rod in the post hole. In prior devices, there is a small amount of clearance between the hinge rod and the post hole allowing the hinge rod to click back and forth with the sudden stopping of a key.

For acoustical reasons tone holes must vary in size such that there is some unevenness in tone and sound radiation. In prior art keys the structure which supports the tone hole cover is not designed to affect sound radiation.

Problems with movement of a musician's finger from one finger button to another in a cluster of keys result in more difficult playing of the instrument. These finger buttons are generally located side by side such that when one button is depressed the transition to another button requires a sliding movement of the finger. This motion is especially awkward because of interruption in the movement of the finger as it contacts the edge of the second button. Some attempts have been made to alleviate this problem by attaching the buttons to one another thereby causing the second button to tilt when the first button is depressed. While this aids finger movement somewhat, considerable awkwardness remains. That is, the finger must overcome general frictional resistance as well as the sudden resistance accompanying finger movement from the plane of one button to the second tilted button. There is also no definite guide for the fingers to move from one button to another.

SUMMARY OF THE INVENTION

The invention is a key system or a wind instrument such as a saxophone. The key system eliminates design and construction problems of prior art key systems without radically changing the fingering pattern. Musician acceptance is thus enhanced. The key system includes a tone hole cover supported by an arm substantially as wide as or wider than the radius of tone hole. Alternatively, two or more arm portions may be used as the arm. A foot portion connects to the arm portion at a point adjacent the hinge sleeve. The foot width at the connection point is substantially the same width as the arm. A means for strengthening this connection point is attached to the foot and to either the arm or the tone hole cover. The arm may be extended across the tone hole cover to further support and stabilize the tone hole cover.

The posts which support the hinge rod and key are provided with multiple legs to stabilize the post on the instrument body. The pad on the underside of the tone hole cover includes a groove in the tone hole cover into which is placed a cushion material. An airtight material cover is placed over the groove and secured on both sides thereof. A foundation attached to one tone hole cover includes a resilient member to contact a second tone hole cover so that they may be moved in combination with one another. Hinge noise is eliminated by pressuring the hinge rod against one side of the post hole with a set screw.

Because of varying tone hole size, an unevenness or distortion of sound may occur. To overcome this a modulating means is employed within the key structure. The modulating means includes holes incorporated on the key structure with the natural vibration frequency of the holes calculated to reinforce or hinder the energy radiated from the tone holes. To prevent the various screws in the keys from vibrating loose, nylon or similar type materials are employed in the screw. For ease of repair or adjustment the springs are mounted on collars which are secured on the keys by set screws. The springs may thus be repaired or adjusted without removing the key.

A cluster of finger contact points is included in the key system to eliminate problems associated with finger sliding between finger buttons which control one or more tone hole covers. The cluster key includes a rigid plate with depressions therein acting as finger contact points. A series of channels connect the depressions so that the fingers of a musician are guided to a desired finger contact point. The rigid plate includes a friction reducing surface to further aid finger movement. The rigid plate is mounted on the instrument such that finger pressure against a contact point pushes the rigid plate against a particular leg. The legs are articulately mounted on the body of the instrument so as to control one or more tone hole covers. One or more desired tone hole covers may thus be controlled by the musician without the difficulty encountered in prior art devices.

BRIEF DESCRIPTION OF THE DRAWINGS

FIG. 18 is a top view of a cluster key;

DESCRIPTION OF THE PREFERRED EMBODIMENT

Figure 1:
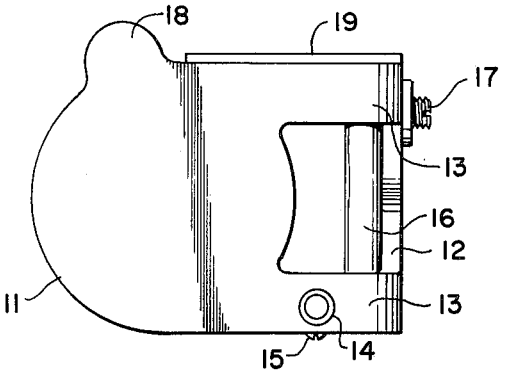
FIG. 1 shows a top view of one embodiment of a wind instrument key of the invention.

Referring to FIG. 1, a top view of one embodiment of a wind instrument key is shown. A tone hole cover 11 is connected with a foot 12 by an arm comprising two or more arm portions 13. A collar 14 is secured in a hole in one of arm portions 13 by a set screw 15. A hinge sleeve 16 is attached at the approximate connection point between arm portions 13 and foot 12. A stop screw 17 is threaded through foot 12. A contact point 18 is attached to cover 11. A strengthening means comprising a brace 19 is attached to cover 11 and foot 12.

Figure 2:
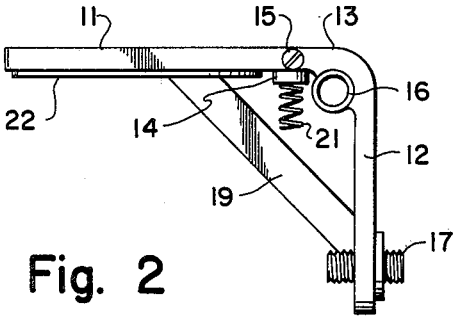
FIG. 2 shows a side view of the key of FIG. 1.

Referring to FIG. 2, a side view of the key of FIG. 1 is shown. Cover 11 is attached to arm portions 13. Arm portions 13 are joined with foot 12 adjacent hinge sleeve 16. Collar 14 is secured to arm portions 13 by set screw 15 through the side of arm portions 13. A stop spring 21 is attached to collar 14 by conventional means. Brace 19 is attached to cover 11 and foot 12. A pad 22 is affixed to cover 11.

Figure 3:
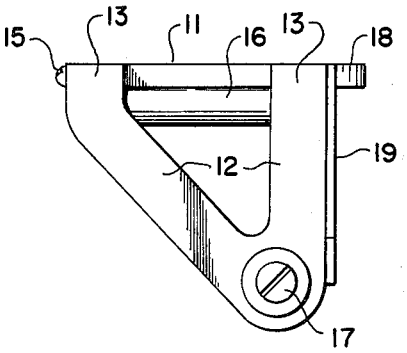
FIG. 3 shows a rear view of the key of FIGS. 1 and 2.

Referring to FIG. 3, a rear view of the key of FIGS. 1 and 2 is shown. Tone hole cover 11 has contact point 18 attached thereto. Foot portions 12 comprise the foot. Stop screw 17 is threaded in foot portions 12. Brace 19 is attached to foot portions 12 and cover 11. Hinge sleeve 16 is joined to foot portions 12 and arm portions 13 adjacent their connecting point. Set screw 15 is threaded into arm portions 13.

Figure 4:
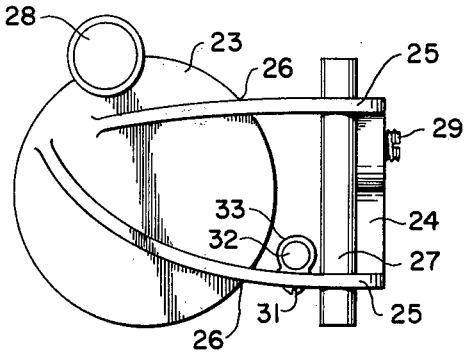
FIG. 4 shows a top view of a preferred embodiment of a tone hole cover, arm, and foot arrangement.

Referring to FIG. 4, a top view of the preferred embodiment of a tone hole cover, arm, and foot arrangement is shown. A tone hole cover 23 is joined with a foot 24 by arm portions 25. Arm portions 25 are attached to cover 23 at points 26 and along the upper side of cover 23. A hinge sleeve 27 is attached to arm portions 25 and foot 24 adjacent their connecting point. A finger contact point 28 is attached to cover 23. A stop screw 29 is threaded into foot 24. A set screw 31 secures a spring collar 32 into sleeve 33.

Figure 5:
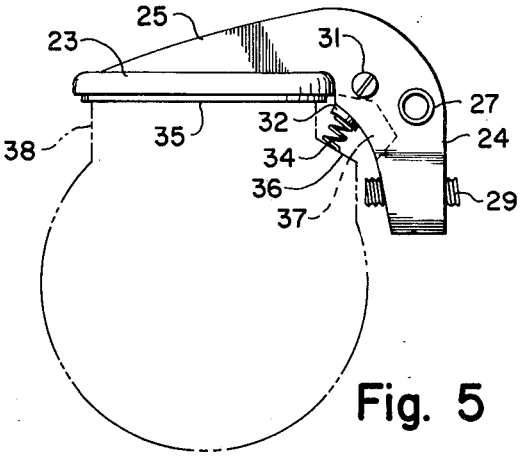
FIG. 5 shows a side view of the key of FIG. 4.

Referring to FIG. 5, a side view of the key of FIG. 4 is shown. Cover 23 is attached to arm 25. Arm 25 extends to hinge sleeve 27 where it is joined to foot 24. A brace 37 generally defined by the dotted line portion strengthens the juncture of arm 25 and foot 24. Stop screw 29 is threaded through foot 24. Set screw 31 secures collar 32 to sleeve 33 (shown in FIG. 4) on arm 25. A sping 34 is connected to collar 32 by conventional means. A pad 35 is attached to cover 23. A stop 36 is attached to a tone hole 38.

Figure 6:
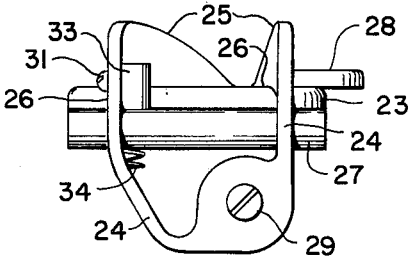
FIG. 6 shows a rear view of the key shown in FIGS. 4 and 5.

Referring to FIG. 6, a rear view of FIGS. 4 and 5 is shown. Cover 23 is attached to arm portions 25 at points 26. Hinge sleeve 27 is attached to arm portion 25 and foot portion 24 adjacent their connecting point. Contact point 28 is attached to cover 23. Stop screw 29 is threaded into foot 24. Set screw 31 secures collar 32 (shown in FIGS. 4 and 5) to sleeve 33. Spring 34 is attached to collar 32.

Figure 7:
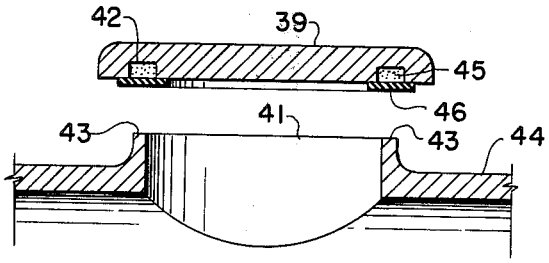
FIG. 7 shows a side sectional view of a tone hole cover and pad.

Referring to FIG. 7, a side sectional view shows a tone hole cover 39 and a tone hole 41 illustrating a novel pad construction. A groove 42 is cut into the underside of cover 39. Groove 42 is wider than lip 43 on the wall of tone hole 41 in body 44. A cushion 45 is mounted in groove 42. A semi-rigid airtight covering 46 as, for example, a skin material, is attached to the underside of cover 39. Covering 46 is wider than groove 42 to allow its attachment to cover 39 on both sides of groove 42.

Figure 8:
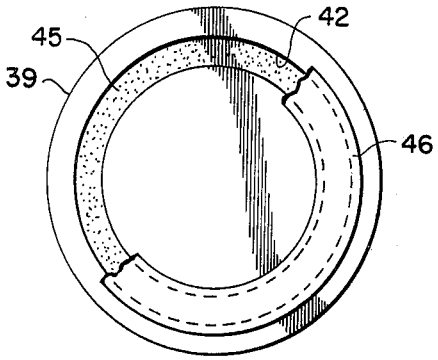
FIG. 8 shows the underside of the tone hole cover of FIG. 7 including a partial cutaway view of the pad construction.

Referring to FIG. 8 the underside of cover 39 including a partial cutaway view of the pad construction is shown. Groove 42 contains cushion 45 substantially filling groove 42. Covering 46 is attached to cover 39 on both sides of groove 42.

Figure 9:
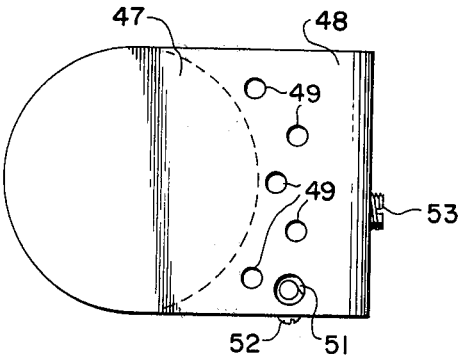
FIG. 9 shows a top view of one embodiment of a wind instrument key.

Referring to FIG. 9, a top view of a wind instrument key is shown. A tone hole cover 47 is generally defined from an arm 48 by the dotted line. Arm 48 has contained therein a plurality of resonance holes 49. Arm 48 is substantially as wide as or wider than the radius of the tone hole covered by cover 47. A collar 51 is secured in a hole in arm 48 by set screw 52. A stop screw 53 is threaded into a foot (shown in FIGS. 10 and 11).

Figure 10:
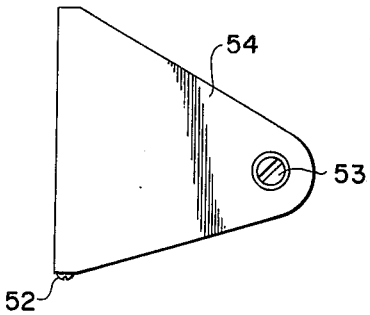
FIG. 10 shows a rear view of the key of FIG. 9.

Referring to FIG. 10, a rear view of the key of FIG. 9 is shown. A foot 54 is shown containing stop screw 53. Set screw 52 is shown threaded into arm 48 (shown in FIG. 9).

Figure 11:
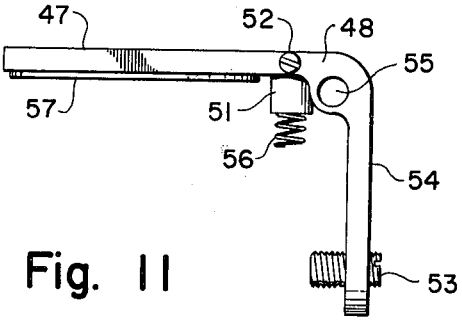
FIG. 11 shows a side view of the key of FIGS. 9 and 10.

Referring to FIG. 11, a side view of the key of FIGS. 9 and 10 is shown. Cover 47 and arm 48 are formed from a single piece of material being defined from each other as shown by the dotted line in FIG. 9. Cover 47 is generally circular in shape and somewhat larger than the tone hole which it is to cover. Foot 54 is also formed from the same piece of material as cover 47 and arm 48. Arm 48 is defined from foot 54 as extending from a point adjacent hinge sleeve 55. That is, foot 54 is generally the downwardly extending portion in FIG. 11. Stop screw 53 is threaded into foot 54. Collar 51 is secured in a hole in arm 48 by set screw 52. A spring 56 is attached to collar 51. A pad 57 is attached to the underside of cover 47.

Figure 12:
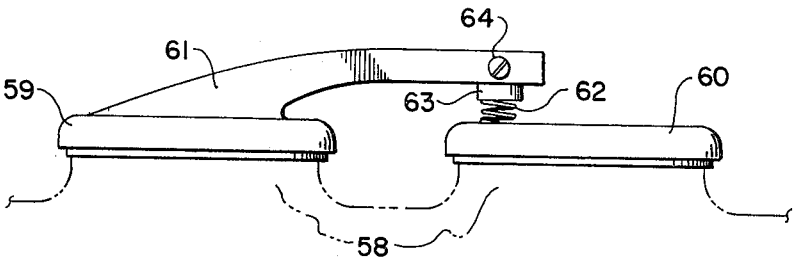
FIG. 12 shows a foundation member resiliently contacting a tone hole.

Referring to FIG. 12, tone holes 58 are covered by tone hole covers 59 and 60. A foundation 61 has mounted thereon a resiliently contacting means which includes a spring 62. Spring 62 is attached to collar 63 which is itself secured in a hole in foundation 61 by set screw 64.

Figure 13:
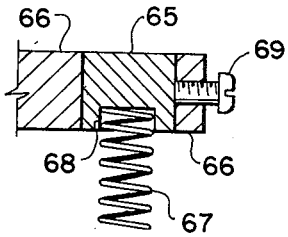
FIG. 13 is a partial cross-section view of a means for containing a spring.

Referring to FIG. 13, a partial cross-sectional view of a spring containing means is shown. A collar 65 is slidably mounted in a hole in structure 66. A spring 67 is glued or otherwise conventionally fastened to a recess 68 in collar 65 as shown. Collar 65 is secured against structure 66 by a set screw 69 in combination with frictional forces.

Figure 14:
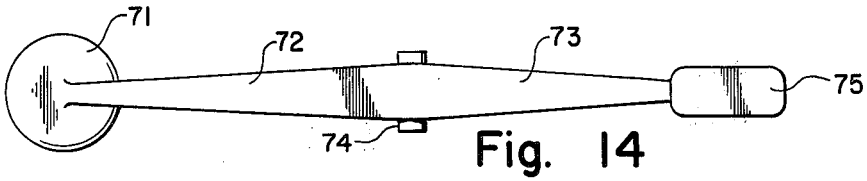
FIG. 14 shows a top view of a long key.

Referring to FIG. 14, a top view of a long key is shown. A tone hole cover 71 is connected to an arm 72. Arm 72 is connected to a foot 73 adjacent a hinge 74. A finger contact point 75 is attached to foot 73.

Figure 15:
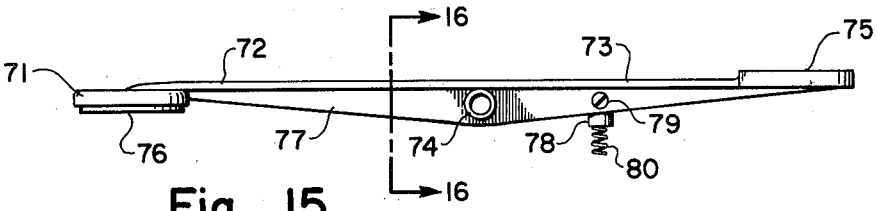
FIG. 15 is a side view of the long key of FIG. 14.

Referring to FIG. 15, a side view of a long key of FIG. 14 is shown. Tone hole cover 71 has mounted thereon a pad 76. Arm 72 is connected to foot 73 adjacent hinge sleeve 74. A means for strengthening the connection point between arm 72 of foot 73 includes a brace 77. Hinge sleeve 74 is attached to brace 77. Finger contact point 75 is attached to foot 73. A collar 78 such as that shown in FIG. 13 is secured to brace 77 by a set screw 79. A spring 80 is attached to collar 78.

Figure 16:
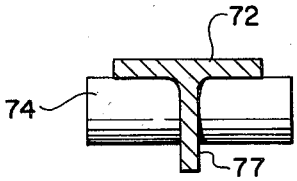
FIG. 16 is a sectional view through line 16—16 of FIG. 15.

Referring to FIG. 16, a sectional view of the long key along line 16—16 of FIG. 15 is shown. Brace 77 may be formed as part of or attached to arm 72 and foot 73. Hinge sleeve 74 runs through brace 77 beneath the connection point of arm 72 and foot 73.

Figure 17:
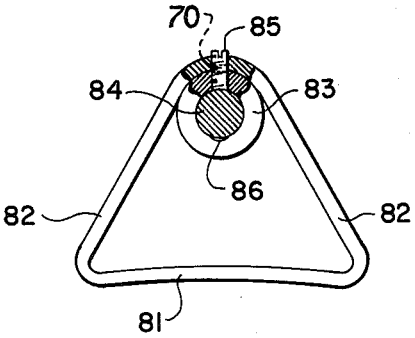
FIG. 17 is a partial sectional view of a post and hinge arrangement.

Referring to FIG. 17, a partial sectional view of a post is shown. A plurality of post legs 82 form a generally triangular shape with a base 81. Hinge sleeve 83 is attached to post legs 82. A hinge rod 84 is contained within hinge sleeve 83. A set screw 85 is threaded through post leg 82 and hinge sleeve 83 to contact hinge rod 84. Hinge rod 84 is thus pressured against a recess 86 on the inside of the hinge sleeve 83. A plug 70, which may be any low plug is inserted through a hole in screw 85 such that both ends contact the female. Plug 70 extends through the approximate center of 85 as shown by the dotted lines in FIG. 17.

Figure 18:
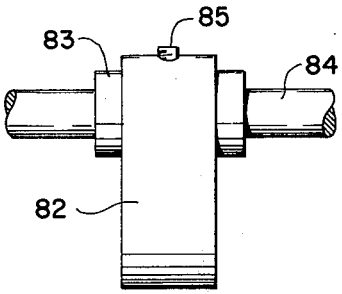
FIG. 18 is a side view of the post and hinge arrangement of FIG. 17.

Referring to FIG. 18, a side view of the post of FIG. 17 is shown. Hinge sleeve 83 is attached to post legs 82. Hinge rod 84 is pressured against hinge sleeve 83 by set screw 85.

Figure 19:
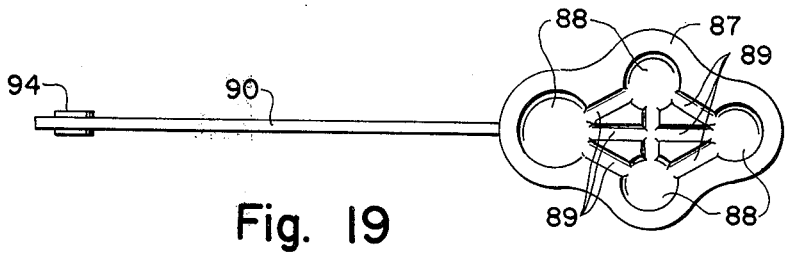

Referring to FIG. 19, a top view of a novel cluster key is shown. A rigid member which may be a plate 87 has a plurality of contact points 88 which may be indentations incorporated thereon. A means for guiding which may include a plurality of grooves 89 is also incorporated into plate 87. Plate 87 is mounted on leg 90. A hinge sleeve 94 is mounted on support 90.

Figure 20:
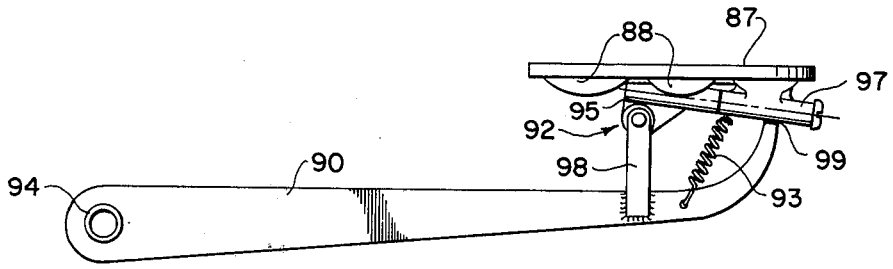
FIG. 20 is a side view of the cluster key of FIG. 19.

Referring to FIG. 20, a side view of the cluster key of FIG. 19 is shown. Plate 87 is mounted on a universal joint generally designated as 92. Joint 92 is connected to leg 90. A spring 93 is connected to plate 87 and leg 90. Leg 90 has a hinge sleeve 94 to allow articulate mounting on the instrument.

Figure 21:
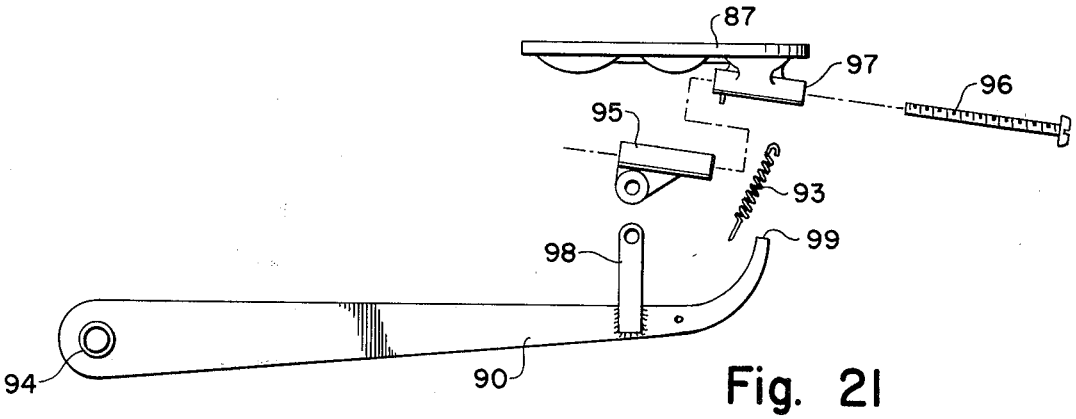
FIG. 21 is a side disassembled view of the cluster key of FIGS. 19 and 20.

Referring to FIG. 21, the cluster key of FIGS. 19 and 20 is shown in a side disassembled view. Plate 87 is attached to a pivot 95 by a screw 96 extending through a mounting bracket 97 allowing articulation of bracket 97 on screw 96. Pivot 95 is itself articulately connected to a bracket 98. Spring 93 connects to mounting bracket 97 and leg 90. Mounting bracket 97 may contact a rest 99 on leg 90.

Figure 22:
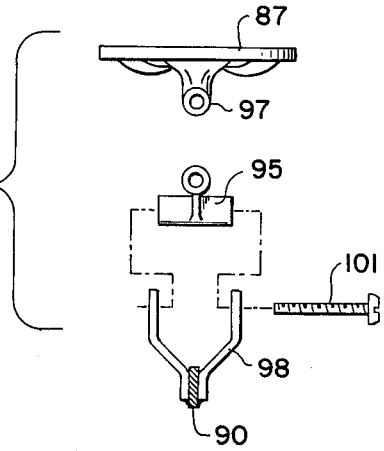
FIG. 22 is a rear disassembled view of the cluster key of FIGS. 19, 20 and 21.

Referring to FIG. 22, a rear disassembled view of the cluster key of FIGS. 19, 20, and 21 is shown. Plate 87 through mounting bracket 97 is articulately connected to pivot 95 as shown in FIG. 21. Pivot 95 is itself articulately connected to bracket 98 by screw 101. Bracket 98 is connected to leg 90 by soldering or other conventional means.

MODE OF OPERATION

Referring to FIG. 1 the problem of misaligned tone hole covers is solved by spaced arm portions 13. The problem may be better visualized by reference to FIG. 7. If tone hole cover 39 were misaligned due to twisting or side to side movement of its attached arm, then it may not seat properly on the tone hole thereby allowing air to escape between airtight cover 46 and lip 43. Referring to FIG. 1, by providing at least two arm portions 13, the tone hole cover is stabilized and is maintained in alignment with the tone hole. While two arm portions 13 are illustrated in FIG. 1 it should be recognized that equivalent structure could be utilized. The arm portions may be a single portion 48 shown in FIG. 9 substantially as wide as or wider than the radius of the tone hole. Other embodiments are possible using three or more arm portions. Thus, by using either a plurality of arm portions or one arm portion substantially as wide as or wider than the radius of the tone hole, a stabilization of the tone hole cover as well as the arm is achieved. Referring to FIG. 4, the tone hole cover may be further stabilized by extending arm portions 25 across tone hole cover 23 from point 26 such that the arm portions act as followers.

The problem of spreading between the arm and the foot is solved as shown in FIG. 2. A brace 19 is attached to foot 12 and tone hole cover 11 to stabilize the connection point adjacent hinge sleeve 16. Spreading between arm portion 13 and foot portion 12 is thus prevented. Of course brace 19 could be attached to arm 13 instead of to tone hole cover 11 if so desired. In the preferred key embodiment shown in FIGS. 4–6, spreading is prevented by using brace portion 37 generally illustrated by the dotted line in FIG. 5. Foot portions 24 and arm portions 25 are connected adjacent hinge sleeve 27. Brace 37 is one solid piece formed as part of foot portions 24 and arm portions 25 rather than being a rod like brace as shown in FIG. 2.

An alternate embodiment of the brace is shown in FIGS. 14–16 on a long key. Referring to FIG. 15, brace 77 extends below arm 72 and foot 73 to strengthen their connection point adjacent hinge sleeve 74. Bending of arm 72 and foot 73 along their length and especially in the region of their connection point is thus prevented. By keeping arm 72 and foot 73 in a preferred positional relationship with respect to one another, misalignment of the tone hole cover with the tone hole is prevented. While FIG. 15 illustrates a planar relation for brace 77, the construction of brace 77 could be employed, for example, with the key of FIG. 2 instead of or in addition to brace connector 19 in FIG. 2. That is, the brace could be placed along the backside of foot 12 in FIG. 3 and extend across arm 13 on the upper side of tone hole cover 11 in FIGS. 1 and 2. This construction would be similar to the follower portion of the arm of the tone hole cover in FIGS. 4 and 5.

Referring to FIG. 12, the problem of bending of a rigid foundation is solved by including a resilient member such as spring 62 on foundation 61. As tone hole cover 59, attached to foundation 61, is pushed downward spring 62 contacts tone hole cover 60. Tone hole cover 60 is adjusted to contact tone hole 58 slightly before tone hole cover 60 and the shock is absorbed by spring 62 rather than by foundation 61 thereby preventing foundation 61 from bending.

As discussed above there is a problem of side to side movement of the foot portion of a key in prior art devices. Referring to FIGS. 3, 6, and 10, foot portions 12, 24 and 54, respectively, are constructed such that the foot portions nearest the hinge are as wide as the arm portions at their connection point. Foot portions 12, 24 and 54 narrow as they extend away from the hinge to the point where stop screws 17, 29 and 53, respectively, are threaded into the foot portions. It should be understood that it is not required for foot portions to narrow, that is, they could extend straight from the hinge and be joined by a bar in FIGS. 3 and 6, or be a solid square or rectangular piece in FIG. 10. Similar to the arm construction, more than two foot portions could be used in the key shown in FIGS. 3 and 6.

The post bending problem may be solved by using a post having a plurality of legs. Referring to FIG. 17, post legs 82 are attached to base 81 which may itself be attached to the instrument. Of course, base 81 is not required and post legs 82 could be attached directly to the instrument. More than two legs could be used to support hinge 84 if support in additional directions is desired. The posts are thus stabilized by employing a plurality of legs such that they will not bend upon exertion of a force.

Uneven key pads caused by movement of the pad skin may be corrected by the pad shown in FIGS. 7 and 8. Tone hole cover 39 has a groove 42 therein which contains the pad cushion 45. Groove 42 is spaced from the outside edge of tone hole cover 39 such that airtight layer 46 may be attached on both sides of groove 42.

Thus any movement of airtight layer 46, such as shrinking of a skin if such is used, does not result in any movement of cushion 45 contained in groove 42. Pad contact with lips 43 is maintained and air is thus prevented from escaping between cover 46 and lip 43.

Replacement or adjustment of a spring with the present invention can be made without removing the key. Referring to FIG. 13, spring 67 is attached by glue or other conventional means to collar 65. Collar 65 is inserted into a cavity in structure 66. A set screw 69 secures collar 65 to structure 66. Thus spring 67 may be replaced or adjusted by loosening set screw 69 and either removing collar 65 or sliding it up or down to the desired adjustment. This type of spring arrangement is used throughout the invention as, for example, in FIG. 9 where screw 52 is used to secure collar 51 to arm 58. Another example of this novel spring arrangement is in FIG. 12 where screw 64 is used to secure collar 63 to foundation 61.

Referring to FIG. 17, loosening of screws in wind instrument keys may be preventted by using a nylon plug 70 inserted into a hole in screw 85. The hole extends transverse to the axis of the screw. Nylon plug 70 is slightly longer than the diameter of the threaded portion of screw 85 such that the ends of the plug contact the female threads into which screw 85 is inserted. Of course, materials other than nylon may be employed as the plug material.

Loose and vibrating hinge rods may be prevented by using a set screw such as that illustrated in FIGS. 17 and 18. Referring to FIG. 17, set screw 85 is threaded through post leg 82 and sleeve 83 to contact hinge rod 84. Recess 86 on the inside of sleeve 83 allows hinge rod 84 to be securely held in place. Specifically, hinge rod 84 is pressured at three points: at screw 85, and at each side of recess 86. Unwanted noise from movement of hinge rod 84 inside of sleeve 83 is thus eliminated.

Variations in tone hole size resulting in unevenness in tone and sound radiation may be eliminated by the incorporation of holes in the keys as shown in FIG. 9. Heretofore, the function of the key structure such as arm 48 has been solely to support a tone hole cover 47. However, the incorporation of holes 49 in a key may be used to enhance the tone. Specifically, the dimension of holes 49 determine their natural vibration frequency which is calculated to either reinforce or hinger the energy radiated from the tone hole. The key itself may thus be used to improve sound quality of the instrument instead of relying solely on the instrument body to control the sound.

The difficulty in sliding between finger buttons has perplexed many wind instrument musicians. The present invention eliminates the transition problem by the cluster key device shown in FIGS. 19–22. Referring to FIG. 19, rigid plate 87 has finger contact points 88 thereon. Contact points 88 function as the finger buttons. Resistance from encountering the edges of the finger buttons is thus eliminated. Contact points 88 are connected by a group of channels 89. The surface of channels 89 may be coated with a friction reducing material such as commercially available "teflon" to facilitate finger movement. Channels 89 act as guides in finger movement and the friction reducing surface further aids in finger movement. Instead of coating the surface of plate 87 with a friction reducing coating the plate itself may be constructed of a friction reducing material such as "teflon".

The cluster key is normally in the position shown in FIG. 20. That is referring to FIGS. 20 and 21, spring 93 pressures plate 87 such that mount 97 contacts rest 99. Plate 87 is mounted on a universal type joint generally designated as 92. The details and construction of joint 92 are shown in FIGS. 21 and 22. Joint 92 allows plate 87 to vacillate in any of four directions depending upon which of the four finger contact points 88 is pressured by the finger of the musician. For ease of illustration, only one leg 90 is shown in FIG. 20. When mounted on the instrument, three other legs would be positioned, one adjacent each contact point 88 such that when a contact point is depressed, rigid plate 87 would tilt in that direction and depress that particular leg. A particular tone hole cover or covers is connected to each leg such that the musician can depress a different desired cover or covers with each of the four finger contact points 88. It should be recognized, of course, that more or less than four contact points 88 may be employed on rigid member 87 without departing from the scope of the invention.

While particular forms of the invention have been described with respect to a particular embodiment thereof, it is not to be so limited as changes and modifications may be made therein which are within the full intended scope of the invention as defined by the appended claims.

The foregoing description, taken together with the appended claims, constitutes a disclosure which enables a person skilled in the mechanical arts and having the benefit of the teachings contained therein to make and use the invention. Further, the structure herein described constitutes a meritorious advance in the art which is unobvious to such skilled workers not having the benefit of these teachings.

What is claimed is:

1. In a wind instrument cluster assembly mounted on an instrument body, a cluster key assembly having a plurality of tone hole covers mounted on the instrument body for movement relative to adjacent tone holes, and a plurality of linkage means each operably connected to each tone hole cover to selectively move such tone hole cover in response to actuation of the associated linkage means by the cluster key assembly, the improvement comprising:

a rigid plate member mounted on said instrument body adjacent the linkage means by universal joint means; and a plurality of contact points defined on the rigid plate at positions around the universal joint means, each of the contact points being adjacent and operably associated with at least one of the linkage means, whereby movement of the plate member around the universal joint means will engage at least one of the plate member contact points with at least one of the linkage means to selectively actuate the plurality of tone hole covers with a single rigid plate.

2. A cluster key assembly as set forth in claim 1 which further includes means to bias the rigid plate to a neutral position not actuating any of the linkage means.

3. A cluster key assembly as set forth in claim 1 in which the rigid plate is articulated at the universal joint means to one of the linkage means to move one of the tone hiles covers upon initial movement of the cluster key assembly, and the remainder of the linkage means are positioned adjacent the contact points for actuation when the first linkage means is moved.

4. A cluster key assembly as set forth in claim 3 in which the linkage means comprises a leg extending from and operably connected to the tone hole cover, and in which the rigid plate is mounted on one such leg by orthogonal pivots comprising the universal joint means whereby the rigid plate may be depressed to actuate the tone hole cover associated with the leg upon which the assembly is mounted, and the remainder of the linkage means may thereafter be selectively actuated by rotating the rigid plate about the orthogonal pivots.

5. A cluster key assembly as set forth in claim 4 in which the rigid plate is biased to a neutral position by a spring mounted between the leg and the rigid plate.

6. A cluster key assembly as set forth in claim 1 in which the rigid plate includes indicia defined on the rigid plate adapted to guide the player by touch from one contact point to another contact point.

7. A cluster key assembly as set forth in claim 6 in which the indicia comprise channels defined on the surface of the rigid plate.

8. A cluster key assembly as set forth in claim 7 in which the channels include a friction reducing surface adjacent thereto on the surface of the rigid plate.

* * * * *

UNITED STATES PATENT AND TRADEMARK OFFICE

CERTIFICATE OF CORRECTION

PATENT NO. : 4,328,734

DATED : May 11, 1982

INVENTOR(S) : James M. Gebler

It is certified that error appears in the above—identified patent and that said Letters Patent is hereby corrected as shown below:

Column 1, line 7, delete "inention" and insert --invention--

Column 1, line 44, delete "tone hole" and insert --body--

Column 2, line 29, delete "then" and insert --than--

Column 3, line 11, after "of" insert --the--

Column 4, line 28, delete "18" and insert --19--

Column 6, line 18, delete "of" and insert --and--

Column 8, line 49, delete "58" and insert --48--

Column 8, line 54, delete "preventted" and insert --prevented--

Column 10, line 34, delete "hiles" and insert --hole--

Signed and Sealed this

*Thirty-first* Day of *August 1982*

[SEAL]

*Attest:*

GERALD J. MOSSINGHOFF

*Attesting Officer*

*Commissioner of Patents and Trademarks*